US005704608A

United States Patent [19]

Petocchi

[11] Patent Number: 5,704,608

[45] Date of Patent: Jan. 6, 1998

[54] SHEET FEEDER DRIVE SYSTEM

[75] Inventor: Ermanno C. Petocchi, Rochester, N.Y.

[73] Assignee: Xerox Corporation, Stamford, Conn.

[21] Appl. No.: 208,258

[22] Filed: Mar. 9, 1994

[51] Int. Cl.[6] ..... B65H 3/06

[52] U.S. Cl. ..... 271/116; 74/655 GA; 271/9; 475/343; 475/29; 475/228

[58] Field of Search ..... 271/9, 116, 10; 74/655 GA; 475/332, 343, 228, 248, 29

[56] References Cited

U.S. PATENT DOCUMENTS

| | | | |
|---|---|---|---|
| 1,408,689 | 3/1922 | Buehler | 475/343 X |
| 1,460,064 | 6/1923 | Keck | 475/228 |
| 1,586,944 | 6/1926 | Burkhardt | 475/343 X |
| 1,704,803 | 3/1929 | Mlinko | 475/228 |
| 3,365,013 | 1/1968 | Lundin et al. | 475/29 X |
| 3,601,211 | 8/1971 | Finke | 475/29 X |
| 3,686,974 | 8/1972 | Little, Jr. | 74/665 GA |
| 3,919,899 | 11/1975 | Parker, Jr. | 475/228 |
| 4,855,794 | 8/1989 | Suzuki | 271/9 X |
| 4,978,112 | 12/1990 | Yokoi | 271/116 X |
| 5,203,553 | 4/1993 | Chiang | 271/116 X |
| 5,253,856 | 10/1993 | Fuchi et al. | 271/116 X |
| 5,324,015 | 6/1994 | Freitag | 271/9 |

FOREIGN PATENT DOCUMENTS

| | | | |
|---|---|---|---|
| 0046827 | 2/1987 | Japan | 271/116 |
| 0247336 | 10/1989 | Japan | 271/116 |
| 0247337 | 10/1989 | Japan | 271/116 |

*Primary Examiner*—William E. Terrell
*Assistant Examiner*—Khoi H. Tran
*Attorney, Agent, or Firm*—H. Fleischer; J. E. Beck; R. Zibelli

[57] ABSTRACT

An epicyclic drive train arrangement having a plurality of output drive members which may be selectively driven from a single input drive member. A frame equipped with two pawls is operated by a single solenoid and spring combination. During successive cycles of solenoid operation, a selected pawl engages its mating gear by action of a solenoid plunger rod. The action prevents rotation of the selected gear while the pawl is engaged. The unselected pawl disengages its mating gear thereby allowing it to freely rotate. Multiple epicyclic drive train arrangements may be configured so as to drive a plurality of sheet feeding apparatuses in an electrophotographic printing machine.

31 Claims, 3 Drawing Sheets

SHEET FEEDER DRIVE SYSTEM

The present invention relates generally to sheet feeders, and more particularly to a mechanical drive wherein a single input drives a plurality of output members.

There are many situations wherein it is desirable to drive a plurality of outputs from a single input drive. This is particularly true in systems wherein a plurality of driving members are required to produce the desired result, but the particular system is only adaptable to receiving a single input drive member. For example, it is well known in electrophotographic printing machines with a plurality of sheet feeders having associated paper trays in the form of paper drawer units or modules into which fresh stacks of copy paper can be loaded. Modern printing machines desirably provide as many as four or more different paper drawer units to provide feeding choices for various sizes or types of sheets as well as for backup feeding.

For example, in printing machines having two or more sheet feeders, sheets of support material from a selected sheet feeder are advanced to a transfer station wherein toner images are transferred to the sheets. The sheet feeders include feed rolls which are driven in a preferred direction to advance the sheet of support material from the stacks thereof. Sequential operation of each of the sheet feeders is usually effected by the operation of a specific drive clutch dedicated to a corresponding sheet feeder. Although clutch mechanisms are well known, their use in sheet feed systems is limited because of the high cost of a conventional clutch mechanism and the inherent problems found in sheet feeding, wherein the operation of the sheet feeder must be coordinated with the operation of the element or elements to which the support material is fed. The following disclosure appears to contain relevant subject matter:

U.S. Pat. No. 3,686,974

Patentee: Little, Jr.

Issued: Aug. 29, 1972

The disclosure of the above-identified patent may be briefly summarized as follows:

U.S. Pat. No. 3,686,974 discloses a mechanical drive arrangement having a plurality of output drive members spaced from the input drive member along the periphery of a circle having a center coincident with the axis of rotation of the input drive member. The output drive members may be selectively driven from a single input drive member. The input drive member is reversible so that it may be driven in a first direction or a second direction. At least one intermediate drive member is supported for movement along a planetary path of travel extending about the axis of rotation of the input drive member so as to engage a selected output driver with the input drive member. A first clutch mechanism rotates the intermediate drive member to engage the selected output drive member with the input drive member when the input drive member is driven in the first direction. A second clutch mechanism drives the selected output drive member when the input drive member is driven in the second direction.

Pursuant to the features of the present invention, there is provided a mechanical drive apparatus. The mechanical drive apparatus comprises an input drive member. A plurality of substantially coaxial output drive members are spaced from the input drive member and extend in a direction substantially transverse thereto. Means are provided for connecting the input drive member with one of the plurality of output drive members.

In accordance with another aspect of the present invention, there is provided an apparatus that includes: a first sheet feeder; a second sheet feeder; and a mechanical drive selectively coupled to the first sheet feeder or the second sheet feeder to advance sheets therefrom.

In accordance with yet another aspect of the present invention, there is provided an electrophotographic printing machine of the type having a plurality of sheet feeders with a mechanical drive being connectable to different ones of the plurality of sheet feeders to advance sheets therefrom, wherein the improvement comprises an input drive member. A plurality of substantially coaxial output drive members are spaced from the input drive member and extend in a direction substantially transverse thereto. Means are provided for connecting the input drive member with one of the plurality of output drive members.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
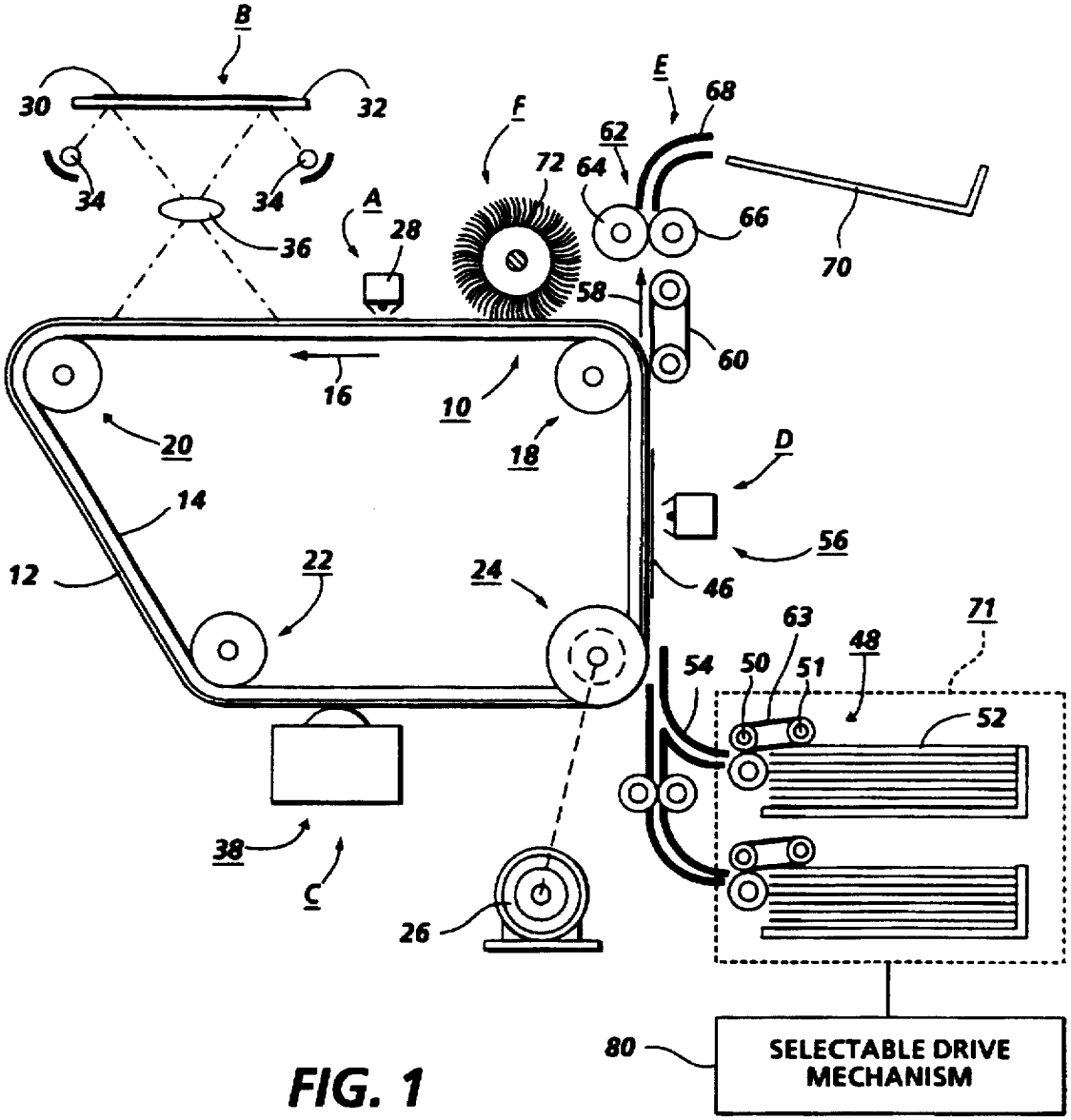
FIG. 1 is a schematic elevational view showing an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the mechanical drive arrangement of the present invention in sheet feeders thereof. It will become evident from the following discussion that the drive mechanism is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning to FIG. 1, the electrophotographic printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

One skilled in the art will appreciate that a Raster Input Scanner (RIS) and a Raster Output Scanner (ROS) may be used instead of the light lens system heretofore described. The RIS contains document illumination lamps, optics, a mechanical scanning mechanism and photosensing elements such as charged couple device (CCD) arrays. The RIS captures the entire image from the original document and converts it to a series of raster scan lines. These raster scan lines are outputted from the RIS and function as the input to the ROS. The ROS performs the function of creating the output copy of the image and lays out the image in a series of horizontal lines with each line having a specific number of pixels per inch. These lines illuminate the charged portion of the photoconductive surface to selectively discharge the charge thereon. An exemplary ROS has lasers with rotating polygon mirror blocks, solid state modulator bars and mirrors. Still another type of exposure system would merely utilize a ROS with the ROS being controlled by the output from an electronic subsystem (ESS) which prepares and manages the image data flow between a computer and the ROS. The ESS is the control electronics for the ROS and may be a selfcontained, dedicated minicomputer.

At development station C, a magnetic brush developer system, indicated generally by the reference numeral 38, transports a developer material of carrier granules having toner particles adhering triboelectrically thereto into contact with the electrostatic latent image recorded on photoconductive surface 12. Toner particles are attracted from the carrier granules to the latent image forming a toner image on photoconductive surface 12.

One skilled in the art will appreciate that a liquid developer material may be used instead of dry developer material.

After development, belt 10 advances the toner powder image to transfer station D. At transfer station D, a sheet of support material 46 is moved into contact with the toner powder image. Support material 46 is advanced to transfer station D by one of a plurality of sheet feeders 48 which are coupled to a multiple selective output drive system, indicated generally by the reference numeral 80. Preferably, the selected sheet feeding apparatus 48 includes a retard roll 51 contacting the uppermost sheet of a stack of sheets 52. Feed roll 50 rotates to advance the uppermost sheet from stack 52 into sheet chute 54. Chute 54 directs the advancing sheet of support material 46 into contact with photoconductive surface 12 of belt 10 in a timed sequence so that the toner powder image developed thereon contacts the advancing sheet of support material at transfer station D. The detailed structure of feed roll 50, retard roll 51, and drive mechanism 80 will be described hereinafter with reference to FIG. 2.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 2:
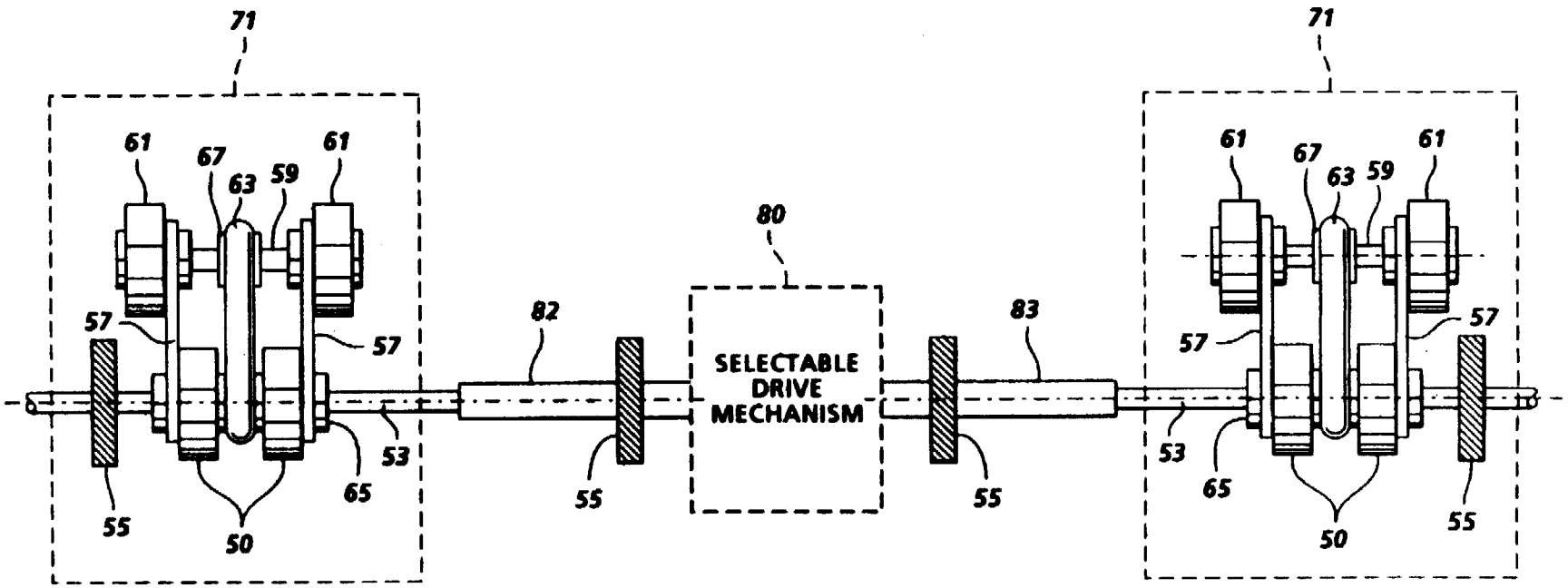
FIG. 2 is a plan view of two feed rolls and a nudger roll selectively driven by the drive mechanism in the sheet feeder of the FIG. 1 printing machine.

Turning now to FIG. 2, which is a plan view of two separate feed roll and nudger roll assemblies 71 selectively driven by drive mechanism 80, the feed rolls 50 are fixedly mounted on feed roll shafts 53 which are mounted on frame supports 55 with one end of each shaft 53 being driven by selectable output shafts 82 or 83, which will be described hereinafter with reference to FIG. 3. A plurality of brackets 57 are journalled on feed roll shaft 53 and supported at the free ends of nudger roll shafts 59, each having two nudger rolls 61 spaced apart. The nudger roll shafts and accordingly the nudger rolls are driven by O-ring drive belts 63 from feed roll drive shafts 53 through drive hubs 65 and 67. The nudger rolls 61, in operation, are on top of a stack of sheets and when driven tend to shingle the sheets in the stack and feed the top sheet to the feed roll retard nip.

Figure 3:
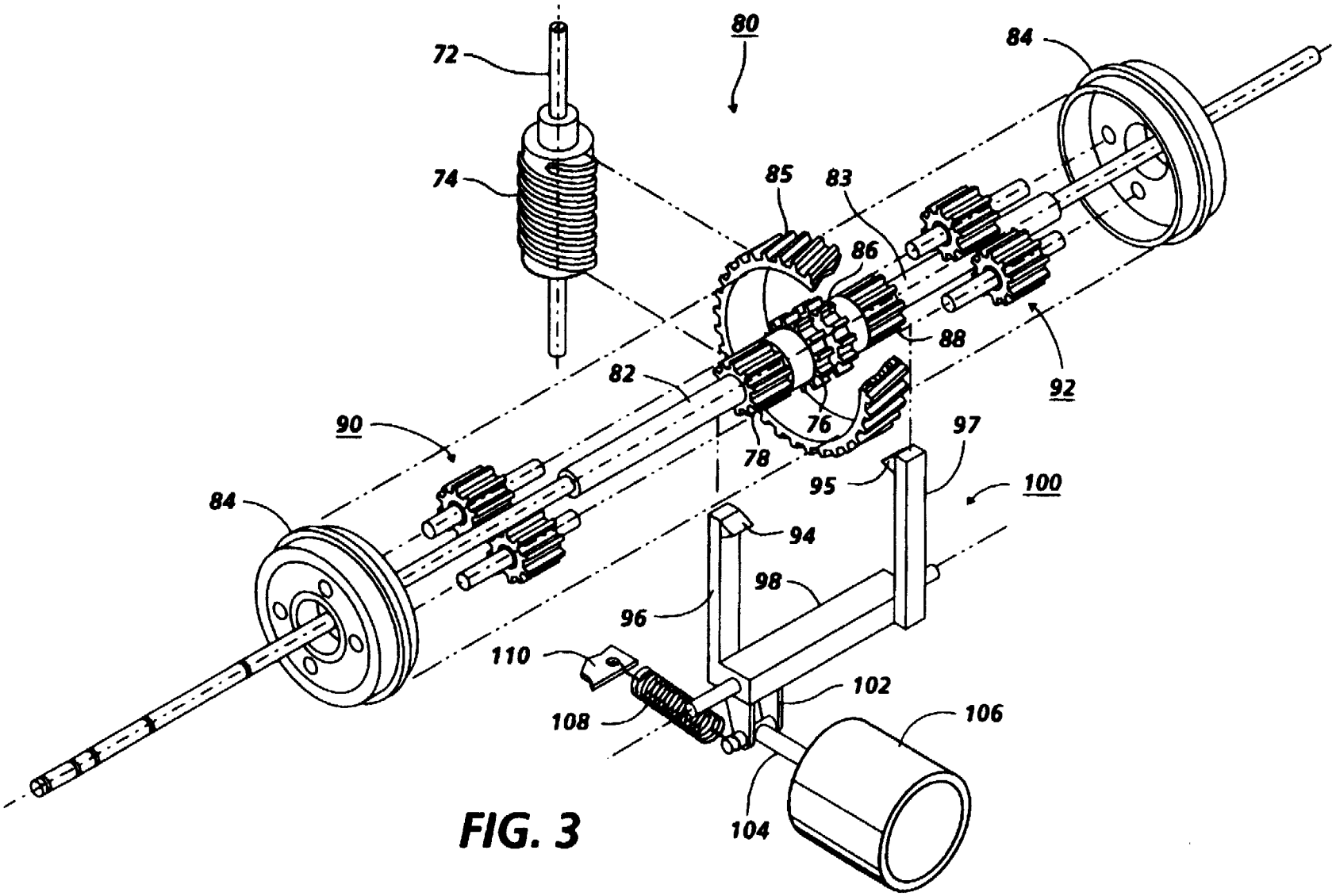
FIG. 3 is an exploded, perspective view of a differential gear used in the FIG. 2 drive mechanism.

Referring now to FIG. 3, which illustrates drive mechanism 80 as a differential gear of output members, such as drive shaft 82 and 83, are supported for rotation between housing plates 84. Housing plates 84 are supported in a generally parallel spaced relationship to each other by being pressed onto opposite ends of a worm wheel 85. An input drive member, such as a shaft 72, is located adjacent to the housing plates 84 and worm wheel 85. The axis of shaft 72 extends generally in a vertical direction that is perpendicular to an axis about which output members 82 and 83 rotate.

An arrangement of gears located between the housing plates 84 cooperate to form a differential gear. The differential gear is designed to have both a first set of sun gears travel around the circumference of a first drive gear (planet gear), and a second set of sun gears travel around the circumference of a second drive gear (planet gear). The action of the differential gear is then used to drive a sheet feeding apparatus (not shown) by transferring a driving force from the input shaft 72 to either a first output drive shaft 82 or a second output drive shaft 83. All the component gears of the differential thus form an epicyclic train for connecting the two shafts 82 and 83 in the same line, dividing the driving force equally between them, and permitting one to revolve while the other is idle.

As may be seen from FIG. 3, a worm driver 74 is supported on shaft 72. The worm driver 74 is of a cylindrical shape possessing a helix that forms a continuous thread to mesh with the external teeth located on the worm wheel 85. Drive members, such as first drive gear 76, and a ratchet gear 78 are operatively connected to first drive shaft 82. Likewise, drive members, such as second drive gear 86 and second ratchet gear 88, are operatively connected to second drive shaft 83. Thus, drive gear 76 and ratchet gear 78 rotate with drive shaft 82. Drive gear 86 and ratchet gear 88 rotate with drive shaft 83. A first pair of sun gears 90 revolve around the drive gear 76 with which they mesh in the epicyclic train. A second similar pair of sun gears 92 revolve around the drive gear 86 with which they mesh in the epicyclic train.

The differential gear transfers a driving force to an output having the least amount of load resistance. By using ratchet mechanisms for arresting motion and producing intermittent action of the force so that it develops its action at particular instants, the differential gear transfers the driving force between the first drive shaft and the second drive shaft.

As may be further seen from FIG. 3, ratchet gear 78 is provided with teeth with which a first drive gear pawl 94 engages. Correspondingly, ratchet gear 88 is provided with teeth with which a second drive gear pawl 95 engages. Pawl 94 and pawl 95 are mounted on vertical members 96 and 97, respectively. Vertical members 96 and 97 are rigidly fixed to a horizontal member 98 forming a pawl frame 100 supporting pawls 94 and 95. Vertical members 96 and 97 are rigidly attached to the horizontal member 98, at opposite ends thereof. They are also attached to opposite sides of horizontal member 98. A vertical stub member 102 is rigidly fixed to horizontal member 98 opposite vertical member 96. Attached to one side of stub member 102 is a free end of a plunger rod 104 of solenoid 106. Also attached to the end of plunger rod 104 connected to stub member 102 is one end of a spring 108. The other end of spring 108 is attached to a frame member 110.

The ratchet-gear mechanism just described with reference to FIG. 3 is used to produce intermittent motion. The pawl frame is equipped with two pawls and is operated by a solenoid and spring combination. During one complete cycle of successive energizing and de-energizing of the solenoid, the selected pawl engages its mating ratchet gear by action of the solenoid plunger rod being pulled into the core of the solenoid. This action prevents rotation of the selected ratchet gear while the pawl is engaged. At the same time, the other pawl is disengaged from its mating ratchet gear allowing it to freely rotate. On the return action, when the solenoid is de-energized, the solenoid plunger rod is retracted from the solenoid core by the spring. The selected ratchet gear previously engaged by its mating pawl is now disengaged and free to rotate. Correspondingly, the other pawl is resiliently urged into engagement with its mating ratchet gear by the spring to prevent rotation of its mating ratchet gear.

As may still be further seen from FIG. 2 and FIG. 3, the feed rolls 50 of a single sheet feeder are fixedly mounted on feed roll shaft 53 and driven by a selected output of the single differential gear. In this configuration, the following events describe the overall operation of the single differential gear in driving one sheet feeder during a sheet feed operation. Initially solenoid 106 is energized such that it locks both the output drive shafts 82 and 83 on the differential gear and the feed roll shafts 53. A motor (not shown) begins to rotate the worm driver 74, which in turn, rotates worm wheel 85, housing plates 84, and output shaft 83. Solenoid 106 is de-energized by a sheet feed operation. A machine logic command de-energizes solenoid 106 in accordance with the output copy sheet size selected by a machine operator. For example, if the operator selects the copy sheet size contained in the sheet feeder connected to shaft 82 the resilient force of spring 108 locks the output shaft 83 on the differential gear. The differential gear is now in a feed position with shaft 82 selected. A driving force from the motor is transmitted through the worm driver 74 to worm wheel 85, and planetary gears 76 and 86, and to output drive shaft 82. The nudger roll shaft and accordingly the nudger rolls are driven by O-ring drive belt 63 from feed roll drive shaft 53 through drive hubs 65 and 67. The nudger rolls feed a top sheet to the feed roll retard nip. At the end of the feed operation, solenoid 106 is again energized to lock both the output drive shafts 82 and 83 of the differential gear along with the corresponding feed roll shaft 53. The driving force from the motor is still transmitted through the worm driver 74 to worm wheel 85, and planetary gears 76 and 86, but is now transferred to output shaft 83. Finally the drive motor de-energizes and the worm driver 74 no longer rotates.

In recapitulation, it is evident that the mechanical drive arrangement with multiple selective outputs of the present invention includes an input drive shaft. A plurality of coaxial output drive shafts are perpendicularly spaced from the input drive shaft. A worm wheel, supported by two housing plates, and a plurality of gears rotatably supported within the worm wheel connect a preselected output drive shaft to the driven input drive shaft. A locking pawl, actuated by a solenoid and a biasing spring, meshes with the preselected output drive shaft to prevent rotation thereof.

It is, therefore, evident that there has been provided, in accordance with the present invention, a sheet feeder drive system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, the patent is intended to embrace all such alternatives, modifications, and variations as are within the broad scope and spirit of the appended claims.

I claim:

1. A mechanical drive apparatus, including:

an input drive member;

a plurality of output drive members spaced from said input drive member;

means for connecting said input drive member with said plurality of output drive members; and a selector, coupled to said connecting means, to prevent rotation of one of said output drive members.

2. A mechanical drive apparatus, including:

an input drive member;

a plurality of output drive members spaced from said input drive member;

means for connecting said input drive member with said plurality of output drive members, said connecting means includes a rotatably mounted worm wheel, and a plurality of gears mounted rotatably within said worm wheel;

a selector, coupled to said connecting means, to prevent rotation of one of said output drive members.

3. A mechanical drive apparatus according to claim 2, wherein said connecting means includes a central gear rotatably connecting each of said output drive members to said plurality of gears.

4. A mechanical drive apparatus, including:

an input drive member;

a plurality of substantially coaxial output drive members spaced from said input drive member and extending in a direction substantially transverse thereto;

means for connecting said input drive member with said plurality of output drive members, said connecting means includes a rotatably mounted worm wheel, a plurality of gears mounted rotatably in said worm wheel, and a central gear rotatably connecting each of said drive members to said plurality of gears; and a selector to prevent rotation, of one of said output drive members.

5. A mechanical drive apparatus according to claim 4, wherein said selector includes:

an actuator; and a plurality of locking members responsive to said actuator so that one of said locking members meshes with a corresponding one of said output members.

6. A mechanical drive apparatus according to claim 5, wherein each one of said plurality of output members includes:

a shaft; and ratchet gear mounted on said shaft.

7. A mechanical drive apparatus according to claim 6, wherein each one of said plurality of locking members includes a pawl adapted to mesh with said ratchet gear to prevent rotation thereof.

8. A mechanical drive apparatus according to claim 7, wherein said actuator includes:

a solenoid coupled to said pawl; and a biasing member resiliently urging said pawl to move in a preferred direction.

9. A mechanical drive apparatus according to claim 8, wherein said biasing member includes a spring.

10. A mechanical drive apparatus according to claim 9, wherein said connecting means further includes a pair of circular plates with each of said plates being connected to an opposed side of said worm wheel.

11. An apparatus for advancing sheets, including:

a first sheet feeder;

a second sheet feeder;

a mechanical drive coupled to said first sheet feeder and said second sheet feeder to advance sheets therefrom; and a selector, coupled to said mechanical drive, to prevent said first sheet feeder from advancing sheets therefrom, with said second sheet feeder advancing sheets therefrom and to prevent said second sheet feeder from advancing sheets therefrom with said first sheet feeder advancing sheets therefrom.

12. An apparatus for advancing sheets, including:

a first sheet feeder;

a second sheet feeder;

a mechanical drive coupled to said first sheet feeder and said second sheet feeder to advance sheets therefrom, said mechanical drive includes an input drive member, a plurality of substantially coaxial output drive members spaced from said input drive member and extending in a direction substantially tranverse thereto, and means for connecting said input drive member with said plurality of output drive members; and a selector, coupled to said mechanical drive, to prevent said first sheet feeder from advancing sheet therefrom with said second sheet feeder advancing sheets therefrom, and to prevent said second sheet feeder from advancing sheets therefrom with said first sheet feeder advancing sheets therefrom.

13. An apparatus for advancing sheets, including:

a first sheet feeder;

a second sheet feeder; and a mechanical drive selectively coupled to said first sheet feeder or said second sheet feeder to advance sheets therefrom, said mechanical drive includes an input drive member, a plurality of substantially coaxial output drive members spaced from said input drive member and extending in a direction substantially transverse thereto, and means for connecting said input drive member with said plurality of output drive members, said connecting means includes a rotatably mounted worm wheel and a plurality of gears mounted rotatably within said worm wheel.

14. An apparatus according to claim 13, wherein said connecting means includes a central gear rotatably connecting each of said output drive members to said plurality of gears.

15. An apparatus according to claim 14, further including a selector to prevent rotation of one of said output drive members.

16. An apparatus according to claim 15, wherein said selector includes:

an actuator; and a plurality of locking members responsive to said actuator so that one of said locking members meshes with a corresponding one of said output members.

17. An apparatus according to claim 16, wherein each one of said plurality of output members includes:

a shaft; and ratchet gear mounted on said shaft.

18. An apparatus according to claim 17, wherein each one of said plurality of locking members includes a pawl adapted to mesh with said ratchet gear to prevent rotation thereof.

19. An apparatus according to claim 18, wherein said actuator includes:

a solenoid coupled to said pawl; and a biasing member resiliently urging said pawl to move in a preferred direction.

20. An apparatus according to claim 19, wherein said biasing member includes a spring.

21. An apparatus according to claim 20, wherein said connecting means further includes a pair of circular plates with each of said plates being connected to an opposed side of said worm wheel.

22. An electrophotographic printing machine of the type having a plurality of sheet feeders with a mechanical drive being coupled to the plurality of sheet feeders to advance sheets therefrom, wherein the improvement includes:

an input drive member;

a plurality of output drive members spaced from said input drive member;

means for connecting said input drive member with said plurality of output drive members; and a selector, coupled to said connecting means, to prevent rotation of one of said output drive members.

23. An electrophotographic printing machine of the type having a plurality of sheet feeders with a mechanical drive being connectable to different ones of the plurality of sheet feeders to advance sheets therefrom, wherein the improvement includes:

an input drive member; a plurality of substantially coaxial output drive members spaced from said input drive member and extending in a direction substantially transverse thereto; and means for connecting said input drive member with said plurality of output drive members, said connecting means includes a rotatably mounted worm wheel, and a plurality of gears mounted rotatably within said worm wheel.

24. A printing machine according to claim 23, wherein said connecting means includes a central gear rotatably connecting each of said output drive members to said plurality of gears.

25. A printing machine according to claim 24, further including a selector to prevent rotation of one of said output drive members.

26. A printing machine according to claim 25, wherein said selector includes:

an actuator; and a plurality of locking members responsive to said actuator so that one of said locking members meshes with a corresponding one of said output members.

27. A printing machine according to claim 26, wherein each one of said plurality of output members includes:

a shaft; and ratchet gear mounted on said shaft.

28. A printing machine according to claim 27, wherein each one of said plurality of locking members includes a pawl adapted to mesh with said ratchet gear to prevent rotation thereof.

29. A printing machine according to claim 28, wherein said actuator includes:

a solenoid coupled to said pawl; and a biasing member resiliently urging said pawl to move in a preferred direction.

30. A printing machine according to claim 29, wherein said biasing member includes a spring.

31. A printing machine according to claim 30, wherein said connecting means further includes a pair of circular plates with each of said plates being connected to an opposed side of said worm wheel.

* * * * *